US007817133B2

(12) United States Patent
Zhou et al.

(10) Patent No.: US 7,817,133 B2
(45) Date of Patent: Oct. 19, 2010

(54) ELECTROPHORETIC DISPLAY PANEL

(75) Inventors: Guofu Zhou, Eindhoven (NL); Willibrordus Jurrianus Dijkman, Eindhoven (NL); Mark Thomas Johnson, Eindhoven (NL)

(73) Assignee: Koninklijke Philips Electronics, Eindhoven (NL)

( * ) Notice: Subject to any disclaimer, the term of this patent is extended or adjusted under 35 U.S.C. 154(b) by 338 days.

(21) Appl. No.: 10/530,379

(22) PCT Filed: Sep. 12, 2003

(86) PCT No.: PCT/IB03/04001

§ 371 (c)(1),
(2), (4) Date: Apr. 6, 2005

(87) PCT Pub. No.: WO2004/034366

PCT Pub. Date: Apr. 22, 2004

(65) Prior Publication Data

US 2006/0092124 A1 May 4, 2006

(30) Foreign Application Priority Data

Oct. 10, 2002 (EP) ..... 02079203

(51) Int. Cl.
*G09G 3/34* (2006.01)

(52) U.S. Cl. ..... 345/107; 359/296

(58) Field of Classification Search ..... 345/107; 359/296

See application file for complete search history.

(56) References Cited

U.S. PATENT DOCUMENTS 5,961,804 A 10/1999 Jacobson et al.
6,120,839 A 9/2000 Comiskey et al.
6,130,774 A * 10/2000 Albert et al. ..... 359/296
2002/0005832 A1 * 1/2002 Katase ..... 345/107
2002/0021483 A1 2/2002 Katase
2002/0180687 A1 * 12/2002 Webber ..... 345/107
2004/0036951 A1 2/2004 Johnson et al.
2006/0202948 A1 * 9/2006 Johnson et al. ..... 345/107
2006/0202949 A1 * 9/2006 Danner et al. ..... 345/107
2006/0232548 A1 * 10/2006 Johnson et al. ..... 345/107
2006/0244713 A1 * 11/2006 Zhou et al. ..... 345/107
2006/0262083 A1 * 11/2006 Zhou et al. ..... 345/107
2006/0274030 A1 * 12/2006 Johnson et al. ..... 345/107
2006/0290650 A1 * 12/2006 Johnson et al. ..... 345/107
2006/0291032 A1 * 12/2006 Zhou et al. ..... 359/296

(Continued)

FOREIGN PATENT DOCUMENTS

WO WO03044765 A1 5/2003

(Continued)

*Primary Examiner*—Bipin Shalwala
*Assistant Examiner*—Afroza Y Chowdhury

(57) ABSTRACT

The electrophoretic display panel (1) for displaying a picture and a subsequent picture has drive means (100) which are able to control for each pixel (2) the potential difference to have a picture value to provide the pixels (2) with a respective picture appearance being either extreme or intermediate, subsequently to have an inter-picture value to provide the pixels (2) with a respective inter-picture appearance, and subsequently to have a subsequent picture value. For the display panel (1) to be able to provide the pixels (2) with the inter-picture appearances which are in general relatively little visible, the drive means (100) are able to control for each pixel (2) an estimate potential difference as the inter-picture value to provide the pixels (2) with a respective estimate picture appearance as the inter-picture appearance.

15 Claims, 2 Drawing Sheets

U.S. PATENT DOCUMENTS

2007/0052668 A1* 3/2007 Zhou et al. ..... 345/107
2007/0052669 A1* 3/2007 Zhou et al. ..... 345/107
2007/0070028 A1* 3/2007 Zhou et al. ..... 345/107
2007/0070029 A1* 3/2007 Johnson et al. ..... 345/107
2007/0146306 A1* 6/2007 Johnson et al. ..... 345/107
2007/0176889 A1* 8/2007 Zhou et al. ..... 345/107
2007/0262949 A1* 11/2007 Zhou et al. ..... 345/107

FOREIGN PATENT DOCUMENTS

WO WO03079323 A1 9/2003

* cited by examiner

ELECTROPHORETIC DISPLAY PANEL

The invention relates to an electrophoretic display panel for displaying a picture and a subsequent picture.

An embodiment of the electrophoretic display panel of the type mentioned in the opening paragraph is described in the non-prepublished European Patent application 01200952.8 (PHNL 010161).

In the described electrophoretic display panel, the appearance of each pixel depends on the potential difference received by the electrodes of the respective pixel and on the history of the respective potential difference. As a consequence of the inter-picture value of the potential difference, the respective pixel has the inter-picture appearance, being substantially equal to one of the extreme appearances, which reduces the dependency on the history. As all pixels have substantially the same inter-picture value, the pixels have mutually substantially equal inter-picture appearances, before the subsequent picture is being displayed. Unfortunately, the pixels having the inter-picture appearances are well visible for an observer, if, as is generally the case, a substantial number of the pixels have intermediate appearances when one of the picture and the subsequent picture is being displayed. The pixels having the inter-picture appearances are less visible if the pixels have the inter-picture appearances during a reduced time interval. This can be realized by increasing the potential differences for providing the pixels with the inter-picture appearances. However, it is undesirable to increase the potential differences as the display panel is intended to operate at relatively low potential differences of for instance 15 Volts.

It is a drawback of the described display panel that the pixels having the inter-picture appearances are in general relatively much visible.

It is an object of the invention to provide a display panel of the kind mentioned in the opening paragraph which is able to have a reduced visibility of the inter-picture appearances of the pixels.

To achieve this object, the display panel in accordance with the invention is specified in claim 1.

The invention is based on the insight that, if the display panel is able to display an estimate of the subsequent picture, as a consequence of the pixels having the inter-picture appearances, the observer perceives a relatively smooth transition from the picture via the estimate of the subsequent picture to the subsequent picture. The display panel is able to display the estimate of the subsequent picture, because the drive means are able to control for each pixel an estimate potential difference as the inter-picture value to provide the pixels with a respective estimate picture appearance as the inter-picture appearance. As a result, the display panel is able to have a reduced visibility of the inter-picture appearances of the pixels.

In an embodiment the respective estimate picture appearance is substantially equal to one of the extreme appearances associated with the subsequent picture appearance. Then the dependency of the appearances of the pixels on the history of the potential differences is reduced.

In a variation of the embodiment the estimate picture appearance of each pixel is substantially equal to the first extreme appearance if the respective subsequent picture appearance is optically closer to the first extreme appearance than to the second extreme appearance, and to the second extreme appearance otherwise.

For instance, if the first and the second extreme appearance of each pixel are white and black, respectively, the pixels are provided with a respective inter-picture appearance substantially equal to white if the respective subsequent picture appearance is optically closer to white than to black, and substantially equal to black otherwise. As a result the estimate of the subsequent picture is being displayed by only substantially black and substantially white pixels, thereby being an estimate of the subsequent picture.

In another variation of the embodiment the drive means are further able to control for each pixel the potential difference for displaying the subsequent picture to have a sequence of preset values, the preset values in the sequence alternating in sign and having an absolute value in the order of the subsequent picture value, and to apply each preset value in the sequence for a duration being at least a factor of two smaller than a largest duration of the durations during which the subsequent picture values will be applied, before having the subsequent picture value. As an advantage, the sequence of preset values reduces the dependency of the appearances of the pixels on the history of the respective potential difference. Such sequences of preset values are described in the non-prepublished European Patent application 02077017.8 (PHNL020441). In a favorable variation of the embodiment the sequence of preset values has a last preset value with equal sign as the sign of the subsequent picture value. As an advantage the display panel has lower power consumption and a smaller duration of the subsequent picture value.

These and other aspects of the display panel of the invention will be further elucidated and described with reference to the drawings, in which.

In all the Figures corresponding parts are referenced to by the same reference numerals.

Figure 1:
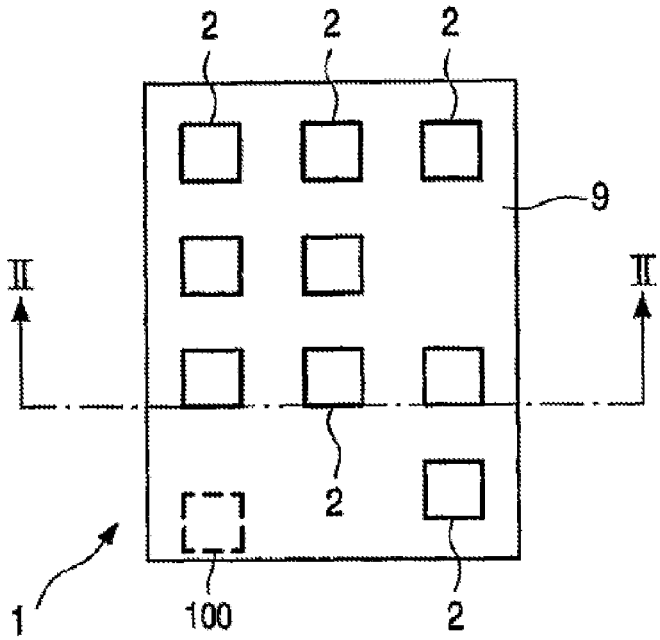
FIG. 1 shows diagrammatically a front view of an embodiment of the display panel.
Figure 2:
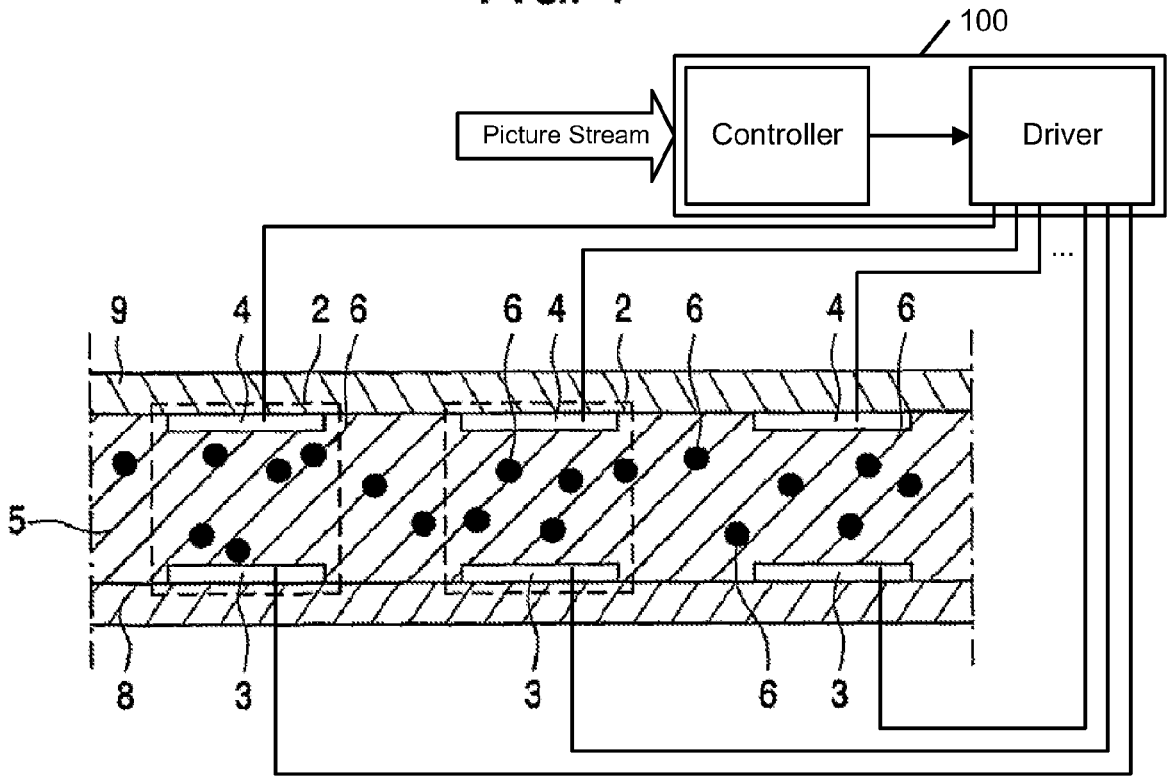
FIG. 2 shows diagrammatically a cross-sectional view along II-II in FIG. 1.

FIGS. 1 and 2 show the embodiment of the display panel 1 having a second substrate 9 and a plurality of pixels 2. The pixels 2 are arranged along substantially straight lines in a two-dimensional structure. Other arrangements of the pixels 2 are alternatively possible, e.g. a honeycomb arrangement. The display panel 1 has a first substrate 8 and a second opposed substrate 9. An electrophoretic medium 5 is present between the substrates 8,9. A first and a second electrode 3,4 are associated with each pixel 2. The electrodes 3,4 are able to receive a potential difference. In FIG. 2 the first substrate 8 has for each pixel 2 a first electrode 3, and the second substrate 9 has for each pixel 2 a second electrode 4. The electrophoretic medium 5 is able to provide each pixel 2 with an appearance, being one of a first and a second extreme appearance and intermediate appearances between the first and the second extreme appearance. Electrophoretic media 5 are known per se from e.g. U.S. Pat. No. 5,961,804, U.S. Pat. No. 6,120,839 and U.S. Pat. No. 6,130,774 and can e.g. be obtained from E Ink Corporation. As an example, the electrophoretic medium 5 comprises negatively charged black particles 6 in a white fluid. When the charged particles 6 are positioned near the first electrode 3 due to a potential difference of 15 Volts, the pixel 2 has a first extreme appearance, i.e.

white. When the charged particles 6 are positioned near the second electrode 4, due to a potential difference of opposite polarity, i.e. −15 Volts, the pixel 2 has a second extreme appearance, i.e. black. The intermediate appearances, e.g. light gray and dark gray, are gray levels between white and black. The drive means 100 are able to control for each pixel 2 the potential difference to have a picture value to provide the pixels 2 with a respective picture appearance, subsequently to have an inter-picture value to provide the pixels 2 with a respective inter-picture appearance, and subsequently to have a subsequent picture value to provide the pixels 2 with a respective subsequent picture appearance. Furthermore, the drive means 100 are able to control for each pixel 2 an estimate potential difference as the inter-picture value to provide the pixels 2 with a respective estimate picture appearance as the inter-picture appearance. Preferably, the respective estimate picture appearance is substantially equal to one of the extreme appearances associated with the subsequent picture appearance. The respective picture appearance is one of the appearances in dependence of the picture to be displayed and the respective subsequent picture appearance is one of the appearances in dependence of the subsequent picture to be displayed.

Figure 3:
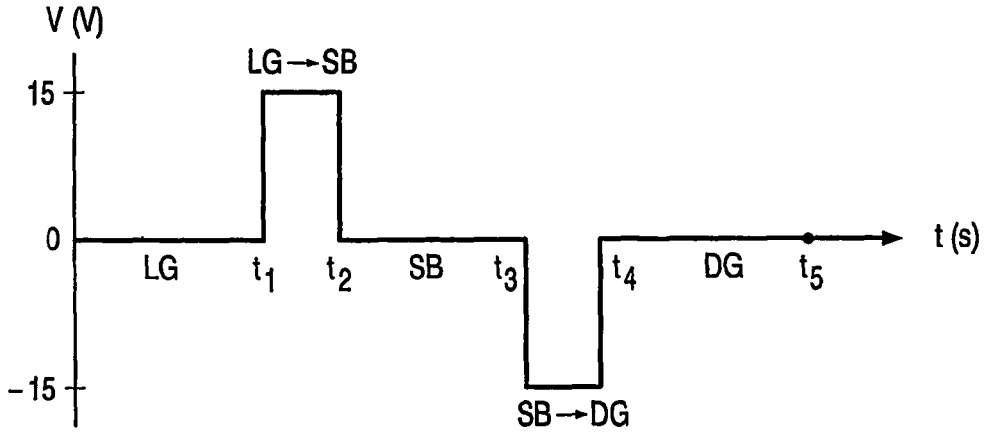
FIG. 3 shows diagrammatically the potential difference as a function of time for a pixel for a variation of the embodiment.
Figure 4:
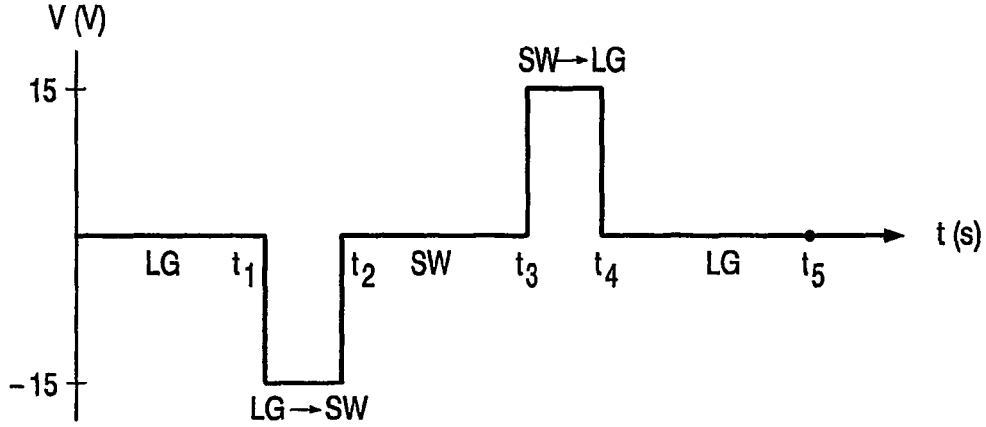
FIG. 4 shows diagrammatically the potential difference as a function of time for a pixel for the variation of the embodiment of FIG. 3.

In a variation of the embodiment, the estimate picture appearance of each pixel 2 is substantially equal to the first extreme appearance if the respective subsequent picture appearance is optically closer to the first extreme appearance than to the second extreme appearance, and to the second extreme appearance otherwise. Optically closer may be related to e.g. luminance or brightness and may be defined on e.g. a linear scale or a scale including gamma-correction. Also the most significant bit of the subsequent picture information may be used to determine which extreme appearance is optically closer. As an example the picture appearance of a pixel 2 is light gray and the subsequent picture appearance of the pixel 2 is dark gray. For this example, the potential difference of the pixel 2 is shown as function of time in FIG. 3. For displaying the picture until time t1, the picture appearance of the pixel 2 is light gray, denoted as LG. As a result of the estimate potential difference of 15 Volts, between time t1 and time t2, representing e.g. 200 ms, the estimate picture appearance is substantially black, denoted as SB, because the subsequent picture appearance is dark gray, denoted as DG, which is optically closer to black than to white. The appearance remains substantially black between time t2 and time t3 due to the estimate potential difference of 0 Volts. The time interval between time t2 and t3 may also be absent. Between time t3 and time t4, representing e.g. 100 ms, the potential difference has the subsequent picture value of −15 Volts. As a result the appearance of the pixel 2 is dark gray. The appearance remains dark gray between time t4 and time t5, as then the subsequent picture value is 0 Volts. In another example both the picture appearance and the subsequent picture appearance of a pixel 2 are light gray. For this example, the potential difference of the pixel 2 is shown as function of time in FIG. 4. For displaying the picture until time t1, the picture appearance of the pixel 2 is light gray. As a result of the estimate potential difference of −15 Volts, between time t1 and time t2, the estimate picture appearance is substantially white, denoted as SW, because the subsequent picture appearance is light gray, which is optically closer to white than to black. The appearance remains substantially white between time t2 and time t3, due to the estimate potential difference of 0 Volts. Between time t3 and time t4 the potential difference has the subsequent picture value of 15 Volts. As a result the appearance of the pixel 2 is light gray. The appearance remains light gray between time t4 and time t5, as then the subsequent picture potential difference is 0 Volts.

Figure 5:
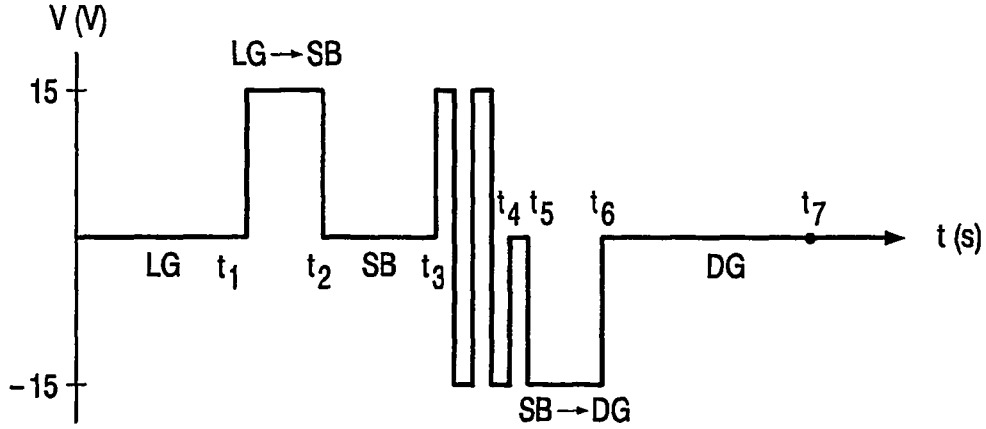
FIG. 5 shows diagrammatically the potential difference as a function of time for a pixel for a further variation of the embodiment.

In a variation of the embodiment the drive means 100 are further able to control for each pixel 2 the potential difference for displaying the subsequent picture to have a sequence of preset values, the preset values in the sequence alternating in sign and having an absolute value in the order of the subsequent picture value, and to apply each preset value in the sequence for a duration being at least a factor of two smaller than a largest duration of the durations during which the subsequent picture values will be applied, before having the subsequent picture value. As an example, the picture appearance of a pixel 2 is light gray and the subsequent picture appearance of the pixel 2 is dark gray. For this example, the potential difference of the pixel 2 is shown as function of time in FIG. 5. Until time t1 the picture appearance of the pixel 2 is light gray. As a result of the estimate potential difference of 15 Volts, between time t1 and time t2, the estimate picture appearance is substantially black and remains substantially black between time t2 and time t3 due to the estimate potential difference of 0 Volts. In the example, the potential difference for displaying the subsequent picture has a sequence of 4 preset values, subsequently 15 Volts, −15 Volts, 15 Volts and −15 Volts, applied between time t3 and t4. Each preset value is applied for e.g. 20 ms. The time interval between t4 and t5 is negligibly small. Subsequently, between time t5 and time t6, representing e.g. 80 ms, the subsequent picture value of the potential difference is −15 Volts. As a result the appearance of the pixel 2 is dark gray. Favorably, as shown in FIG. 5, the last preset value and the subsequent picture value have equal sign. The appearance remains dark gray between time t6 and time t7, due to the subsequent picture potential difference of 0 Volts.

It will be apparent that within the scope of the invention many variations, e.g. display panels having colored pixels, are possible for a person skilled in the art.

The invention claimed is:

1. An electrophoretic display panel for displaying a picture and a subsequent picture comprising:

a first substrate and a second substrate opposed to the first substrate;

an electrophoretic medium between the first substrate and the second substrate;

a plurality of pixels;

a first electrode and a second electrode associated with each pixel for receiving a potential difference; and a driver;

the electrophoretic medium being able to provide each pixel with an appearance, being one of a first extreme appearance, a second extreme appearance and intermediate appearances between the first extreme appearance and the second extreme appearance, and the driver being able to control for each pixel the potential difference:

to a picture value that provides the pixel with a respective picture appearance being one of the appearances in dependence of the picture to be displayed, subsequently to an inter-picture value that provides the pixel with a respective inter-picture appearance, and subsequently to a subsequent picture value that provides the pixel with a respective subsequent picture appearance being one of the appearances in dependence of the subsequent picture to be displayed, wherein the driver is able to control for each pixel an estimate potential difference as the inter-picture value that provides the pixels with a respective estimate picture appearance as the inter-picture appearance, and wherein, for changing an initial pixel appearance to a final pixel appearance, the driver provides:

an initial pulse having an initial duration, an initial value and an initial sign for changing the initial pixel appearance to a substantially extreme appearance being substantially equal to one of the extreme appearances associated with the final picture appearance, a plurality of pulses alternating in sign and having the initial value, wherein a first pulse of the plurality of pulses has a same sign as the initial sign, and a last pulse of the plurality of pulses has a final sign which is opposite the initial sign, each pulse of the plurality of pulses having a pulse duration which is less than the initial duration, and a final pulse having the final sign and a final duration larger than the pulse duration.

2. The display panel of claim 1, wherein the estimate picture appearance of each pixel is substantially equal to:

the first extreme appearance if the respective subsequent picture appearance is optically closer to the first extreme appearance than to the second extreme appearance, and the second extreme appearance otherwise.

3. A method of driving an electrophoretic display panel, comprising the acts of:

receiving first picture values of a first picture and second picture values of a subsequent picture, determining inter-picture values based on at least the second picture values, and applying a sequence of potential differences across electrodes of pixels of the electrophoretic display, the sequence including:

potential differences corresponding to the first picture values, potential differences corresponding to the inter-picture values, and potential differences corresponding to the second picture values, wherein, for changing an initial pixel appearance to a final pixel appearance, the method comprises the acts of:

providing an initial pulse having an initial duration, an initial value and an initial sign for changing the initial pixel appearance to a substantially extreme appearance being substantially equal to one of the extreme appearances associated with the final picture appearance, providing a plurality of pulses alternating in sign and having the initial value, wherein a first pulse of the plurality of pulses has a same sign as the initial sign, and a last pulse of the plurality of pulses has a final sign which is opposite the initial sign, each pulse of the plurality of pulses having a pulse duration which is less than the initial duration, and providing a final pulse having the final sign and a final duration larger than the pulse duration.

4. The method of claim 3, wherein the set of extreme image values includes black and white.

5. The method of claim 3, wherein determining each inter-picture value includes selecting the extreme image value that is closest in value to a corresponding second picture value.

6. A display device, comprising:

a controller that is configured to:

receive first picture values of a first picture and second picture values of a subsequent picture, and determine inter-picture values based on at least the second picture values, and a driver that is configured to apply a sequence of potential differences across electrodes of pixels of an electrophoretic display, the sequence including:

potential differences corresponding to the first picture values, potential differences corresponding to the inter-picture values, and potential differences corresponding to the second picture values, wherein, for changing an initial pixel appearance to a final pixel appearance, the controller is further configured to provide:

an initial pulse having an initial duration, an initial value and an initial sign for changing the initial pixel appearance to a substantially extreme appearance being substantially equal to one of the extreme appearances associated with the final picture appearance, a plurality of pulses alternating in sign and having the initial value, wherein a first pulse of the plurality of pulses has a same sign as the initial sign, and a last pulse of the plurality of pulses has a final sign which is opposite the initial sign, each pulse of the plurality of pulses having a pulse duration which is less than the initial duration, and a final pulse having the final sign and a final duration larger than the pulse duration.

7. The display device of claim 6, wherein the set of extreme image values includes black and white.

8. The display device of claim 6, wherein the controller is configured to select the extreme image value that is closest in value to a second picture value corresponding to each inter-picture value.

9. The electrophoretic display panel of claim 1, wherein the pulse duration is at least a factor of two smaller than the final duration.

10. The electrophoretic display panel of claim 1, wherein the pulse duration is substantially 20 ms and the final duration is substantially 80 ms.

11. The electrophoretic display panel of claim 3, wherein a most significant bit of a subsequent picture information associated with the subsequent picture appearance is used to determine which extreme appearance is optically closer to the estimate picture appearance.

12. An electrophoretic display panel for displaying a picture and a subsequent picture comprising:

a first substrate, and a second substrate opposed to the first substrate;

an electrophoretic medium between the first and second substrates;

a plurality of pixels;

a first and a second electrode associated with each pixel of the plurality of pixels for receiving a potential difference; and driver means for controlling the potential difference between the electrodes for each pixel of the plurality of pixels;

and wherein, the electrophoretic medium provides each pixel of the plurality of pixels with an appearance, being one of a first and a second extreme appearance and intermediate appearances between the first and the second extreme appearance, and the driver means controls, for each pixel of the plurality of pixels, the potential difference to provide:

a picture value to provide the pixels with a respective picture appearance being one of the appearances depending on the picture to be displayed, subsequently, one or more inter-picture values to provide the pixels with one or more respective inter-picture appearances, and subsequently a subsequent picture value to provide the pixels with a respective subsequent picture appearance being one of the appearances depending on the subsequent picture to be displayed, the driver means reduces the visibility of the one or more respective inter-picture appearances, and the driver means controls for each pixel of the plurality of pixels an estimate potential difference as inter-picture value so that a respective inter-picture appearance is an estimate of the respective subsequent picture appearance, wherein, for changing an initial pixel appearance to a final pixel appearance, the driver means provides:

an initial pulse having an initial duration, an initial value and an initial sign for changing the initial pixel appearance to a substantially extreme appearance being substantially equal to one of the extreme appearances associated with the final picture appearance, a plurality of pulses alternating in sign and having the initial value, wherein a first pulse of the plurality of pulses has a same sign as the initial sign, and a last pulse of the plurality of pulses has a final sign which is opposite the initial sign, each pulse of the plurality of pulses having a pulse duration which is less than the initial duration, and a final pulse having the final sign and a final duration larger than the pulse duration.

13. A display panel as claimed in claim 12 wherein the estimate picture appearance of each pixel of the plurality of pixels is substantially equal to:

the first extreme appearance if the respective subsequent picture appearance is optically closer to the first extreme appearance than to the second extreme appearance, and the second extreme appearance if the respective subsequent picture appearance is optically closer to the second extreme appearance than to the first extreme appearance.

14. A display panel as claimed in claim 13 wherein the drive means control, for each pixel of the plurality of pixels, the potential difference for displaying the subsequent picture with a sequence of preset values, the preset values in the sequence alternating in sign and having an absolute value in the order of the subsequent picture value, and the drive means applies each preset value in the sequence for a duration being at least a factor of two smaller than a largest duration of the durations during which the subsequent picture values will be applied, before having the subsequent picture value.

15. A display panel as claimed in claim 14 wherein the sequence of preset values has a last preset value with sign equal to the sign of the subsequent picture value.

* * * * *